US006439750B2

(12) United States Patent
Klaus et al.

(10) Patent No.: US 6,439,750 B2
(45) **Date of Patent: *Aug. 27, 2002**

(54) BARRIER WALL MOUNTING PLATE FOR ELECTRICAL FIXTURE ENCLOSURE

(75) Inventors: Dale Klaus, St. Albans; Richard Ursch, Fenton, both of MO (US)

(73) Assignee: DAL Partnership, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/837,667

(22) Filed: Apr. 18, 2001

Related U.S. Application Data

(63) Continuation-in-part of application No. 09/376,836, filed on Aug. 18, 1999.

(51) Int. Cl.[7] ..... F21V 19/02
(52) U.S. Cl. ..... 362/418; 362/147; 362/427
(58) Field of Search ..... 362/418, 429, 362/430, 287, 147, 432

(56) References Cited

U.S. PATENT DOCUMENTS 1,659,404 A 2/1928 Lipschutz
5,477,439 A * 12/1995 Kowalenko et al. ..... 362/260
5,537,304 A 7/1996 Klaus
5,549,266 A 8/1996 Mitchell et al.
6,257,743 B1 * 7/2001 Ursch ..... 362/418

* cited by examiner

*Primary Examiner*—Sandra O'Shea
*Assistant Examiner*—John Anthony Ward
(74) *Attorney, Agent, or Firm*—Polster, Lieder, Woodruff & Lucchesi

(57) ABSTRACT

A lighting fixture has a canopy formed thereon. Electrical wiring for a lamp socket of the fixture is routed through the canopy. One end of each wire electrically connects to the socket, and the other end of each wire extends through the canopy. A mounting plate fits in opening defined by the canopy and is secured to the canopy. The plate has a central opening through which the free ends of the wires extend. The mounting plate includes a swivel bar attached to the plate on its side to connect it to an outlet box. By attaching the outlet box to the swivel bar, and then the mounting plate to the fixture, the fixture can be adjusted to any orientation regardless of the orientation of the outlet box. In one embodiment, the swivel bar is replaced with arcuate slots through which fasteners extend to allow the plate (and hence the fixture) to be set to a desired orientation with respect to the outlet box. The lighting fixture, in one embodiment, includes a socket assembly comprising a mounting bar which is mounted to the plate at one end and to which a socket is mounted at an opposite end. The cover and socket assembly are both independently mounted to the plate. Hence, no wiring is associated with the cover, per se.

21 Claims, 9 Drawing Sheets

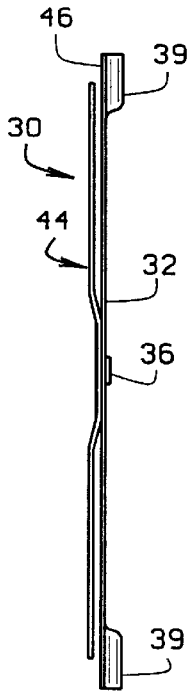
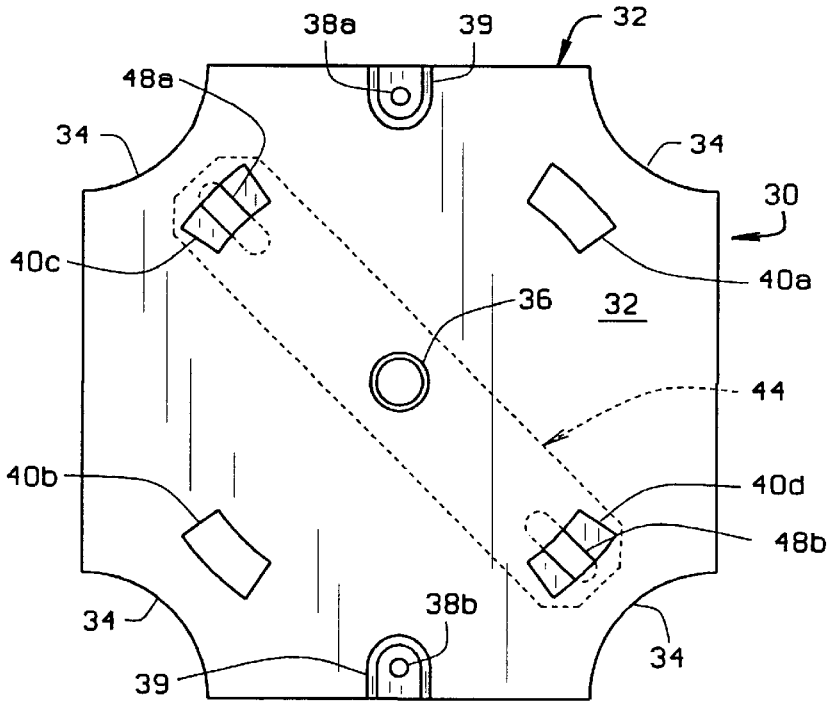
FIG. 5B FIG. 5A
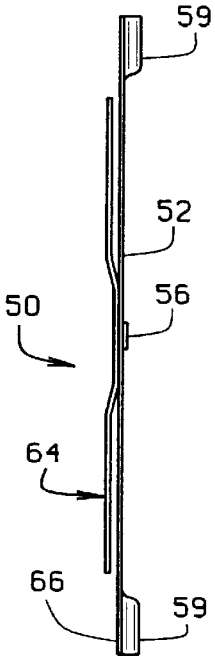
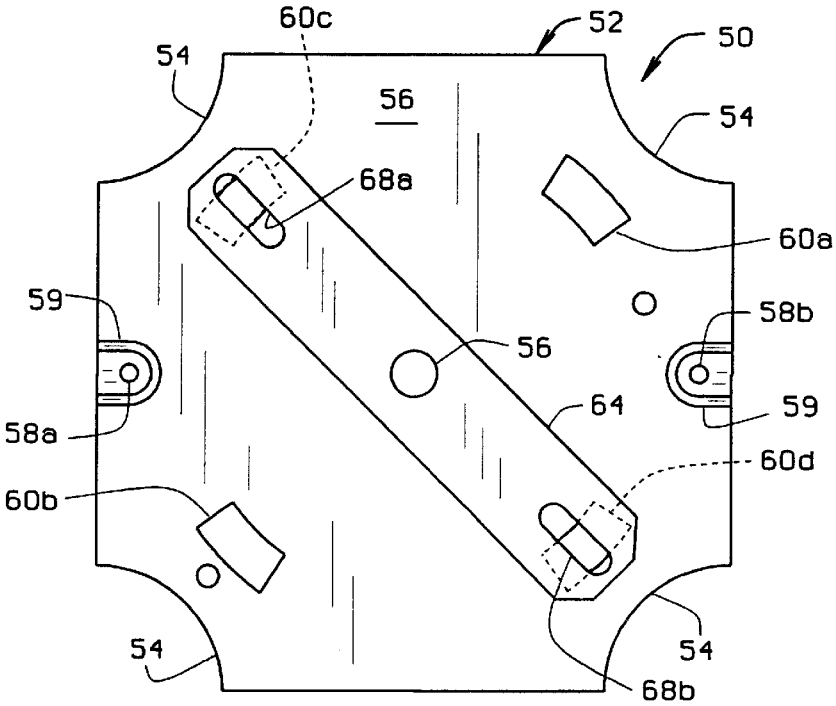
FIG. 6B FIG. 6A

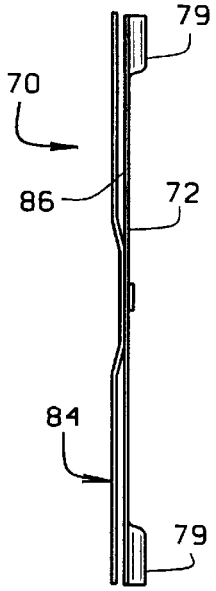
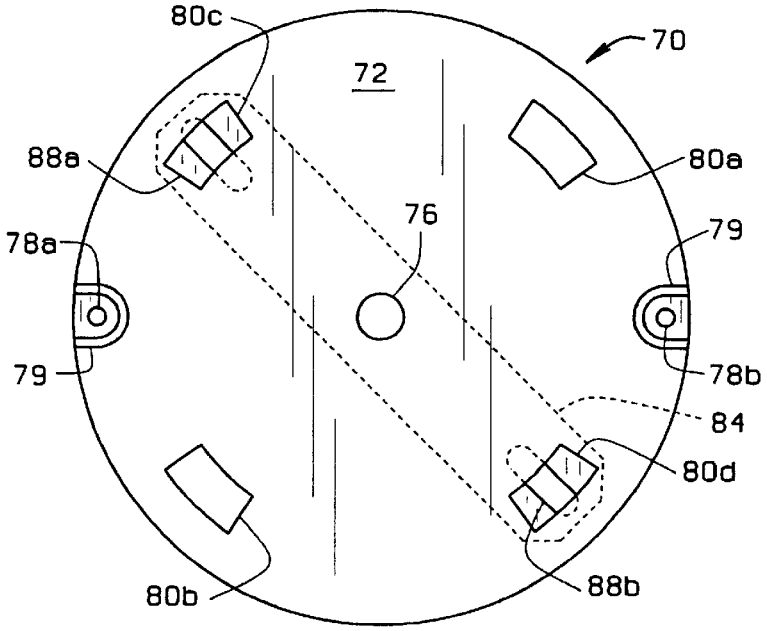
FIG. 7B FIG. 7A
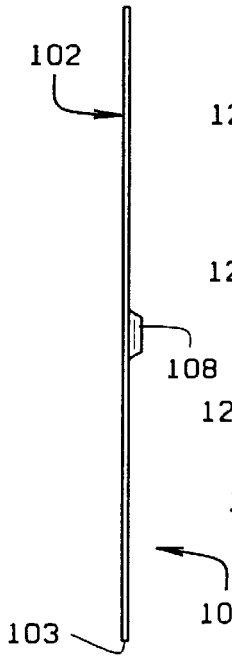
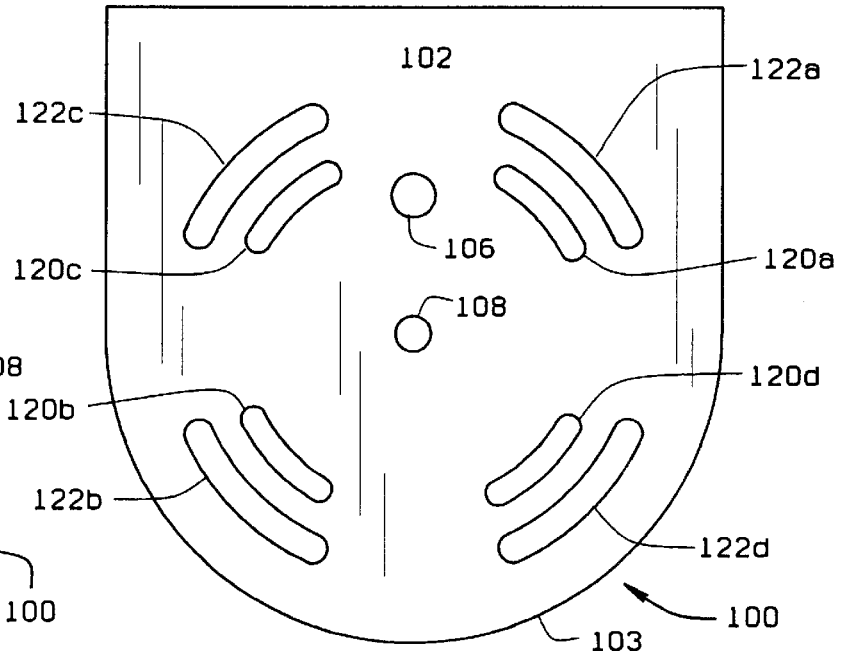
FIG. 8B FIG. 8A

BARRIER WALL MOUNTING PLATE FOR ELECTRICAL FIXTURE ENCLOSURE

CROSS-REFERENCE TO RELATED APPLICATIONS

This is a continuation-in-part of co-pending application Ser. No. 09/376,836 filed Aug. 18, 1999 entitled BARRIER WALL MOUNTING PLATE FOR ELECTRICAL FIXTURE ENCLOSURE, which is incorporated herein by reference.

STATEMENT REGARDING FEDERALLY SPONSORED RESEARCH OR DEVELOPMENT

Not applicable.

BACKGROUND OF THE INVENTION

This invention relates to electrical fixtures such as ornamental lighting fixtures and the like, and more particularly, to a mounting plate for use in installing the fixture.

Referring to the prior art construction shown in FIG. 1, an electrical lighting fixture such as an outdoor lighting fixture F is made of metal or a molded plastic material. On one side of the fixture a canopy C is formed through which electrical wiring W for a lamp socket K is routed. The fixture typically includes three electrical wires W1–W3 one end of each of which are electrically connected to the lamp socket. The other ends of each wire are initially free.

A mounting plate P is formed to fit in an opening defined by an inner wall surface of the canopy. Electrical wires (not shown) from a wall switch or the like are routed through an opening G in a sidewall S of an electrical outlet box B which is already mounted in place in a wall. Ends of these other electrical wires are spliced together with the free ends of the wires W1–W3, and the exposed ends of the attached wires are covered with wire nuts U that are threaded onto the wires. Mounting plate P is then attached to outlet box B by screws (not shown) which fit through holes H formed in the plate. The spliced ends of the wires are now completely enclosed within a space defined by the outlet box B and mounting plate P. This must be done in accordance with paragraph 7.1 of Underwriter's Laboratory (UL) standard 1571, in order for the fixture to receive UL approval. The mounting plate is now attached to canopy C by screws E which fit through notches or holes R formed on opposite sides of the mounting plate, and through openings (not shown) in the canopy. The ends of the screws E project through these openings and cap nuts T are threaded onto the exposed ends of the screws to provide a decorative appearance. This rigidly attaches the mounting plate and outlet box to the fixture.

From an aesthetic standpoint, an installed fixture such as outdoor lighting fixture F is mounted in a preferred orientation, vertical, for example. The fixture, when mounted in place, should not appear to be canted to one side or the other. However, it often occurs that the fixture is canted when the fixture/outlet box assembly is installed in place, and this condition can be time consuming and costly to correct.

BRIEF SUMMARY OF THE INVENTION

In accordance with the invention, generally stated, a lighting fixture made, for example, of metal or a molded plastic material includes a canopy formed on one side. Electrical wiring for a lamp socket of the fixture is routed to the socket through the canopy. One end of each wire is electrically connected to the socket, and the other, free end of each wire extends through the canopy. A mounting plate fits over an opening defined by the canopy and is secured to the outlet box. The mounting plate has generally the same shape as the fixture canopy so to form a barrier between the outlet box and the canopy. The plate has a central opening through which the free ends of the wires extend. Electrical wires for connecting the fixture to a power source are routed through an opening in a sidewall of an electrical outlet box. Ends of these electrical wires are spliced together with the free ends of the other wires, and the exposed ends of the spliced wires are covered with wire nuts, electrical tape, or the like. The mounting plate could include a swivel bar attached to the plate on the side of the plate to which the outlet box attaches. The swivel bar is first attached to the outlet box, and the fixture canopy is then attached to the mounting plate. This allows the fixture to be positioned in any orientation regardless of the outlet box orientation. The electrical wires are completely enclosed by the outlet box and mounting plate as required by UL standards. Other objects and features will be in part apparent and in part pointed out hereinafter.

In one embodiment, the socket is mounted within, and connected to the cover or rain shield. In a second embodiment, the socket is mounted on an arm and is separate from cover. The arm (with the socket) and the cover are individually connected to the barrier mounting plate. Preferably, the arm is removably connected to the barrier plate.

BRIEF DESCRIPTION OF THE SEVERAL VIEWS OF THE DRAWINGS

FIGS. 5A and 5B, and 6A and 6B illustrate alternative embodiments of a rectangular plate for use with other fixtures;

FIGS. 7A and 7B and 8A and 8B illustrate generally circular shaped plates for use with yet other fixtures;

Corresponding reference characters indicate corresponding parts throughout the drawings.

DETAILED DESCRIPTION OF THE INVENTION

Figure 1:
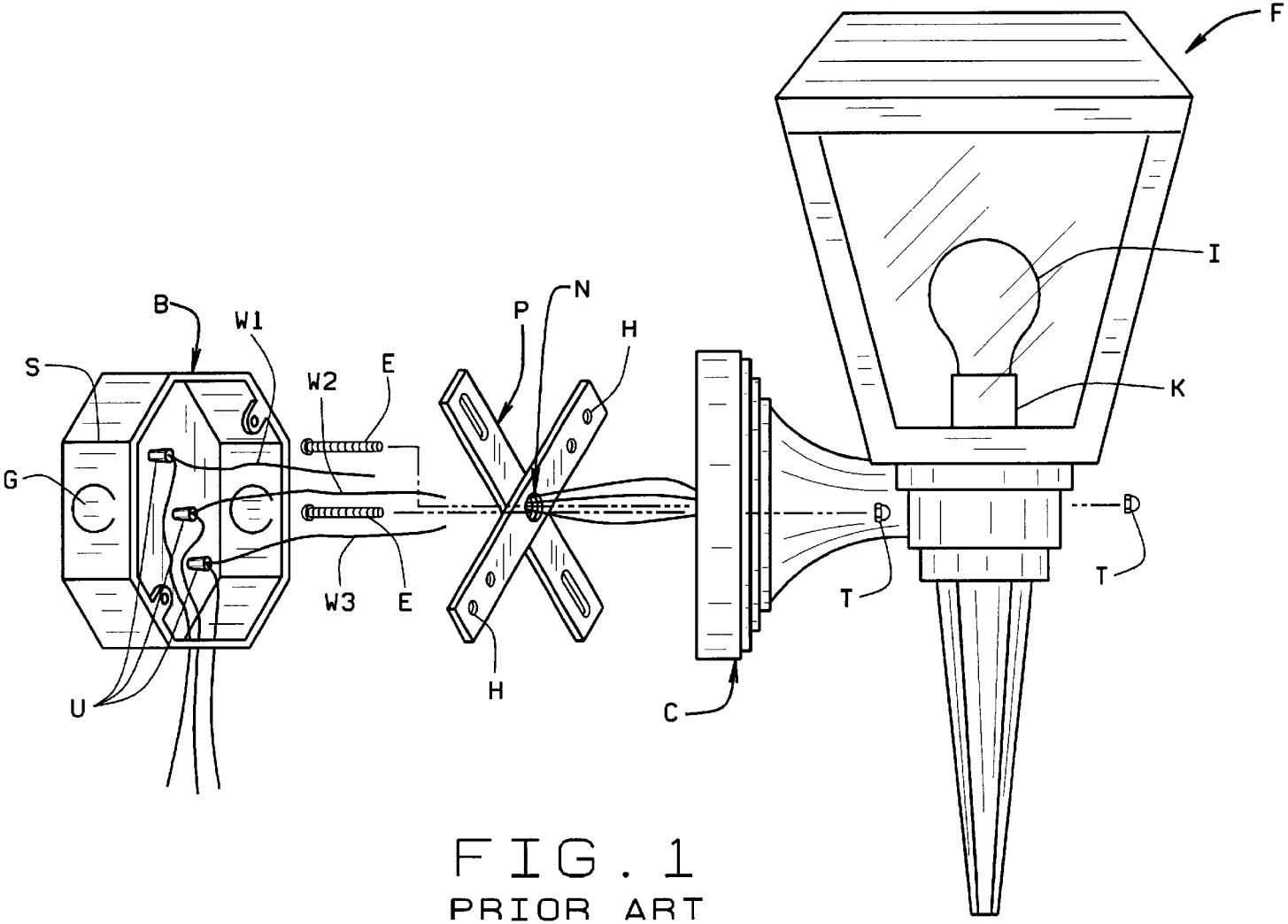
FIG. 1 PRIOR ART
FIG. 1 is an exploded view of a prior art electrical fixture/outlet box assembly.
Figure 2:
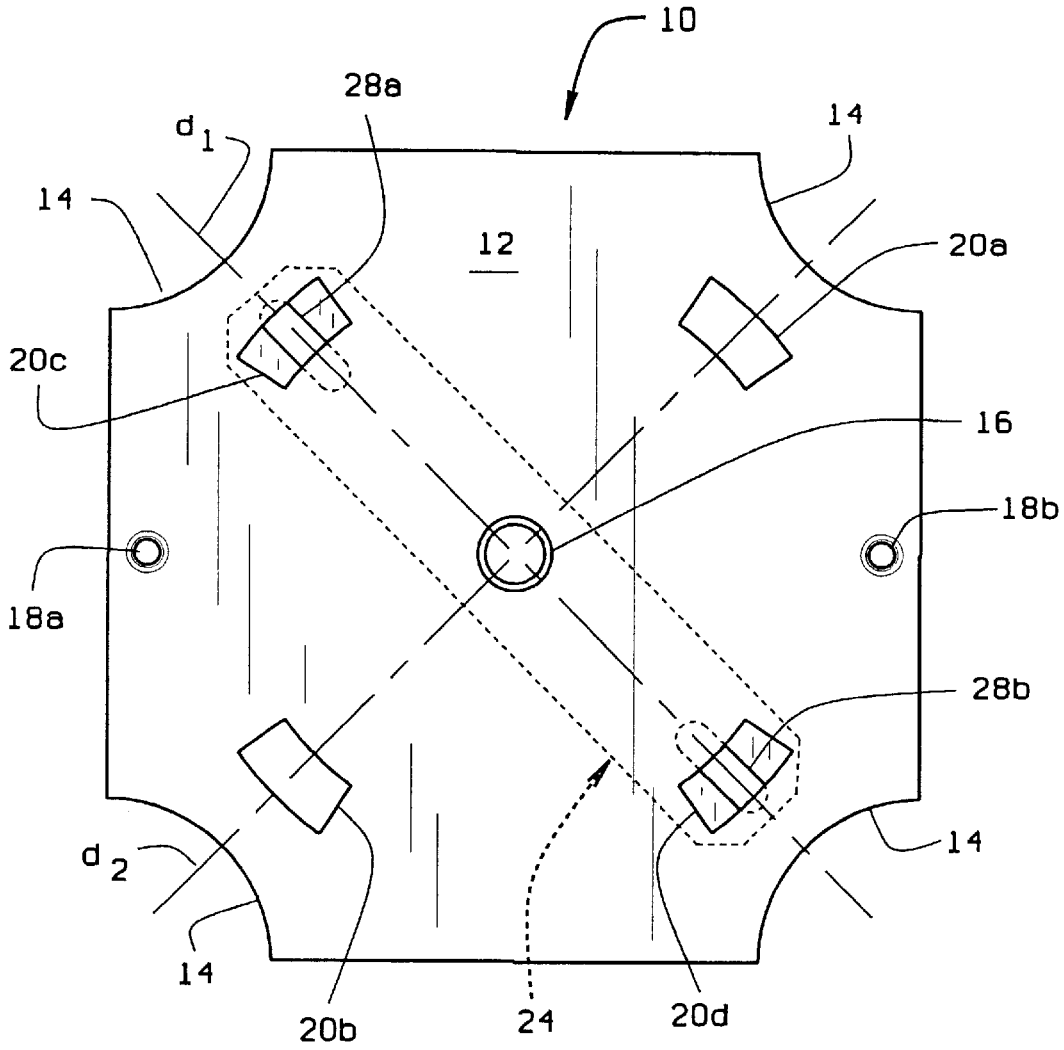
FIG. 2 is a rear elevational view of a mounting plate of the present invention.
Figure 3:
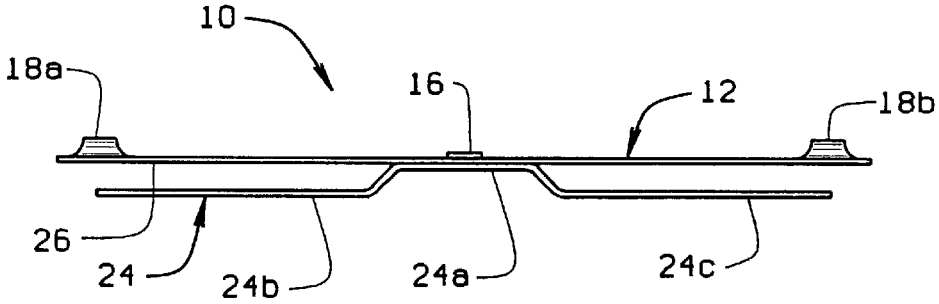
FIG. 3 is a side elevational view of the mounting plate.

Referring to the drawings, the prior art construction shown in FIG. 1 has been previously described, as have the installation problems associated therewith. Referring to FIGS. 2 and 3, an improvement of the present invention includes a barrier wall mounting plate 10 for use with fixture F and replaces the mounting plate P described with respect to FIG. 1. The barrier wall mounting plate 10 includes a flat plate 12 whose outer contour is shaped so the mounting plate is received in an opening defined by an inner wall of a fixture canopy. For example, as shown in FIG. 2, each corner of the plate is scalloped, as indicated at 14. The plate 10 has an opening 16 for the free ends of electrical wires connected to the fixture lamp socket to be pulled through the opening. Opening 16 is swedged and edge rolled as shown in FIG. 3. Plate 12 further includes a pair of opposed, tapped openings 18*a*, 18*b*. These openings are for attaching the mounting plate to the fixture canopy. The mounting plate is attached to canopy C by screws, such as the screws E, which fit through the tapped openings, and through openings (not shown) in the canopy.

Four arcuate segments 20*a*–20*d* are formed in plate 12. The segments form opposed pairs of segments which are centered on respective diagonals d1, d2 extending from the corners of plate 12. The width of each segment is sufficient for the head of a screw 22 (FIG. 4) to fit through the segment.

A swivel bar 24 is rotatably mounted on a side 26 of the plate 12. This is the side of the mounting plate to which an outlet box B attaches to the mounting plate. Swivel bar 24 is rotatable through 360°. The swivel bar has a middle section 24*a* which abuts side 26 of the barrier wall mounting plate. Outer sections 24*b*, 24*c* respectively extend outwardly of the ends of this middle section and are raised away from the side of the mounting plate. Each outer section 24*b*, 24*c* has an elongate slot 28*a*, 28*b*, respectively extending longitudinally of the swivel bar 24.

When the ends of the wires are spliced together and the wire nuts are fitted onto the wires, the mounting plate 12 is attached to the outlet box B using the screws 22. The threaded shank of the screws 22 are inserted through one of the arcuate segments (segments 20*c* and 20*d* in FIG. 4) and then through one of the slots 28*a*, 28*b* into a treaded bore (not shown) in the base of the outlet box. The slot width is sufficiently narrow so the head of the screws do not fit through the slots. Thus, when the screws are tightened, mounting plate 10 is drawn up tight against the outlet box. The screws E are now threaded through the tapped bores 18*a*, 18*b* in the plate and through the openings in the canopy. The exposed ends of the screws are covered by the cap nuts T to again provide a decorative appearance.

Because the outlet box is attached to the swivel bar portion of the mounting plate, fixture F can be oriented as desired by the installer without having to make cumbersome adjustments to the fixture/outlet box assembly. And, in accordance with paragraph 7.1 of Underwriter's Laboratory (UL) standard 1571 the spliced ends of the wires are not exposed. However, whereas in the prior art construction of FIG. 1, the outlet box and fixture canopy defined the enclosure in which the spliced ends of the wires were contained; now, this enclosure is defined by the outlet box and barrier wall mounting plate 10. Additionally, the novel construction of barrier wall mounting plate 10 allows the electrical fixture (whether or not a lighting fixture) to be molded out of polymeric materials which do not have to meet UL requirements for an electrical enclosure. The design of mounting plate 10 also addresses those requirements relating to the maximum size of open holes in an enclosure such as are specified in Table 9.1 of UL standard 1571 relating to incandescent fixtures. Finally, while lighting fixture F is for use with an incandescent light bulb 1, the mounting plate 10 construction described herein is also useful with fixtures for fluorescent lights and other types of lighting as well.

Figure 4:
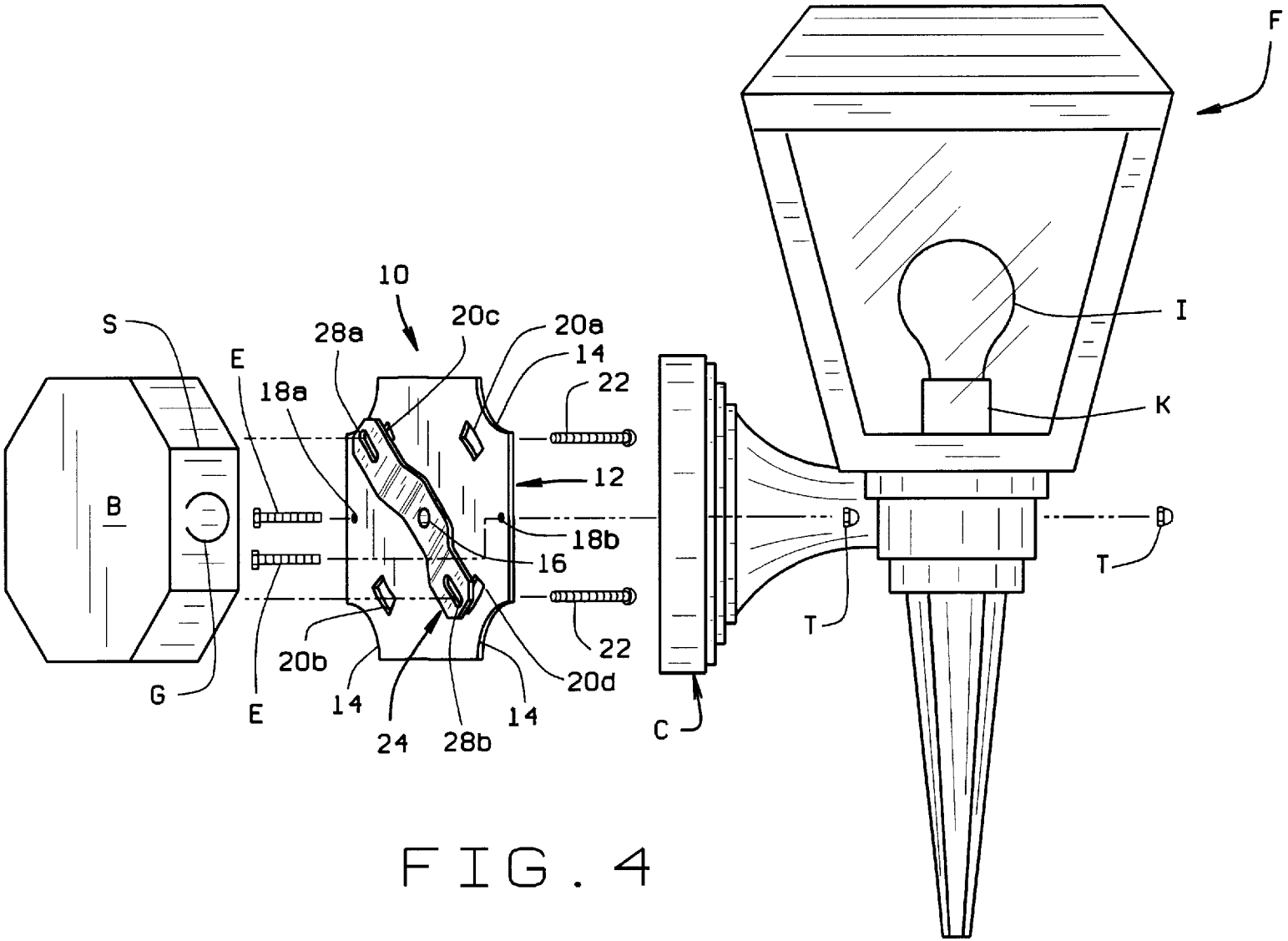
FIG. 4 is an exploded view illustrating an electrical fixture/outlet box assembly using the mounting plate of the present invention.
Figure 9:
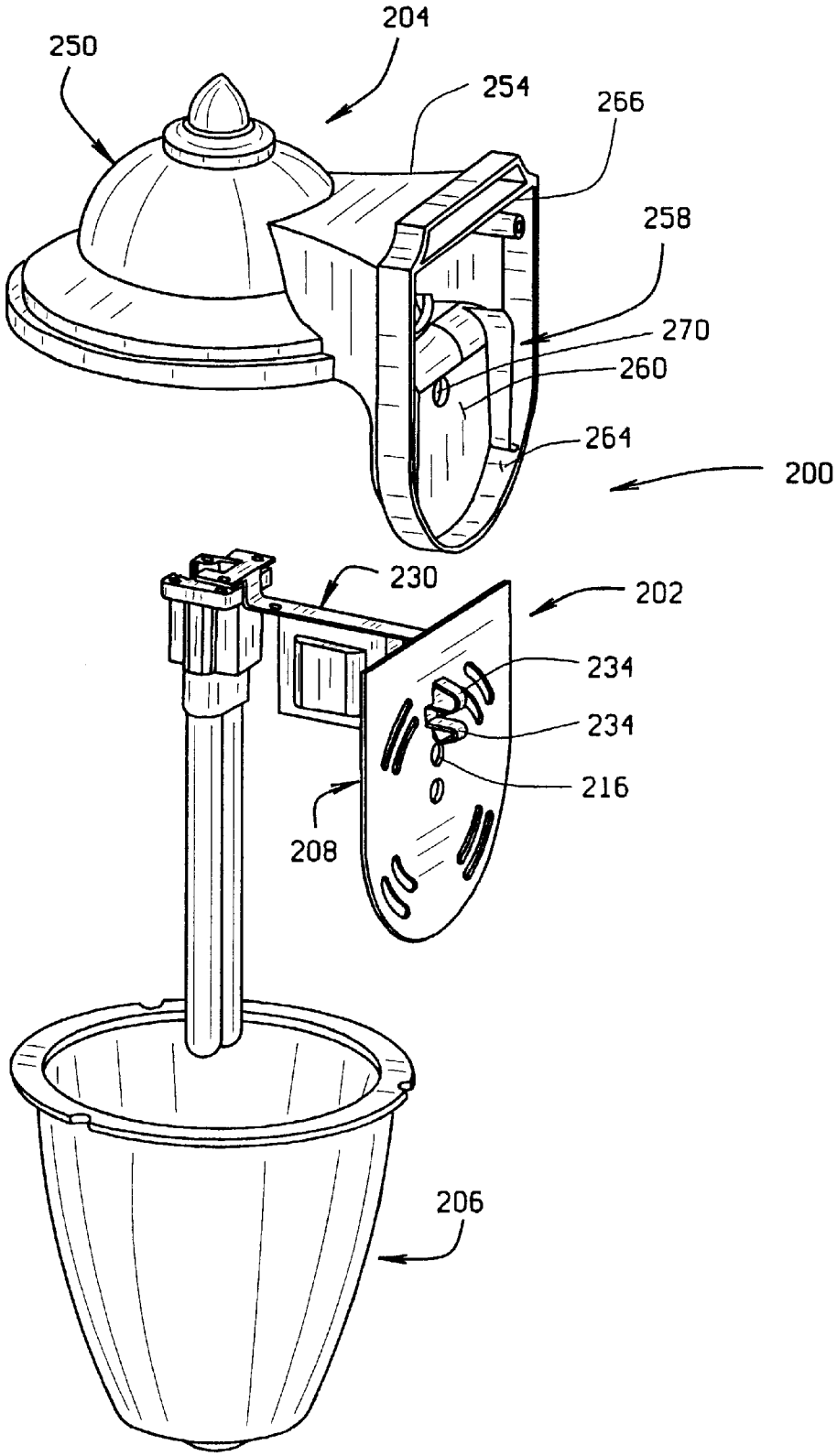
FIG. 9 is a side perspective view of an alternative embodiment of the lighting fixture in which the lamp is mounted directly to the mounting plate and the canopy is closed around the lamp, and mounted to the mounting plate.
Figure 10:
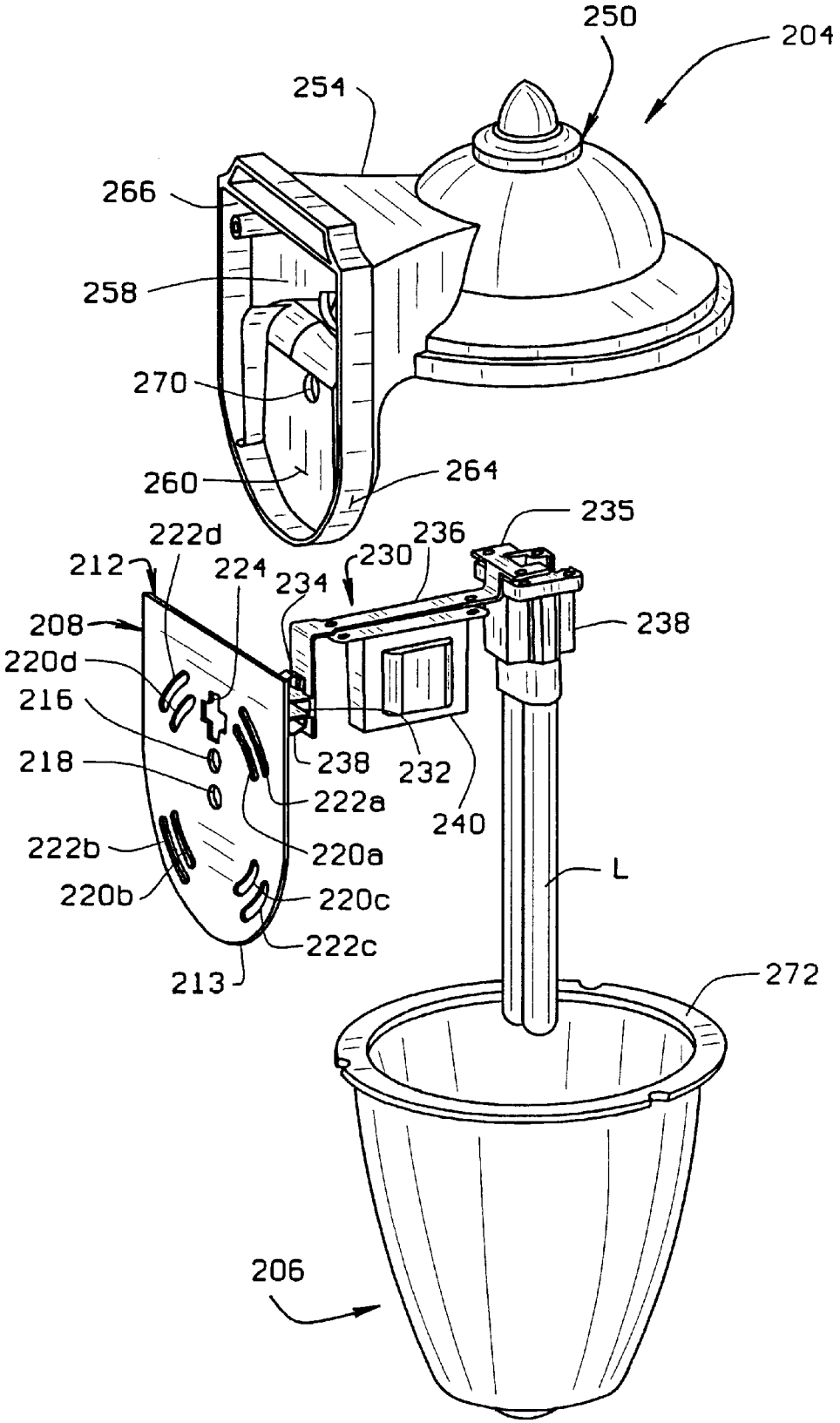
FIG. 10 is a rear perspective, exploded view of the lighting fixture.

Although not shown in the drawings, it will be understood by those skilled in the art that barrier wall mounting plate 10 can be installed backward to the installation shown in FIG. 4. That is, plate 12 could be attached to outlet box B and swivel bar 24 to canopy C.

Referring to FIG. 5A, 5B and 6A, 6B, other barrier wall mounting plate constructions are indicated 30 and 50 respectively. Each mounting plate includes a flat plate 32, 52 with scalloped corners 34, 54. An opening 36, 56 is formed in the respective plates for routing the electrical wiring. Each plate has opposed, tapped openings 38a, 38b and 58a, 58b respectively, these openings being in wells 39, 59 formed in the respective plates 32, 52. Four arcuate segments 40*a*–40*d* and 60*a*–60*d* constructed in the same manner as the segments 20*a*–20*d* are formed in the respective plates 32, 52. Swivel bars 44, 64 and attached on sides 46, 66 of the plates 32, 52. Elongate slots 48*a*, 48*b* and 68*a*, 68*b* are formed at the respective ends of each bar 46, 66, the slots extending longitudinally of the respective swivel bars. Use and installation of the barrier wall mounting plates 30, 50 is as previously described.

FIGS. 7A, 7B illustrate a circular barrier wall mounting plate 70. Since plate 70 is circular and not square or rectangular, it does not have scalloped corners. Again, the mounting plate fits within a similarly shaped fixture canopy. The mounting plate 70 includes a flat plate 72. An opening 76 is formed in the plate for routing the electrical wiring. Opposed, tapped openings 78*a*, 78*b* are formed in wells 79 at the periphery of the plate 72. Four arcuate segments 80*a*–80*d* which are constructed in the same manner as the segments 20*a*–20*d* are formed in the plate 72. A swivel bar 84 is attached to side 86 of the plate 72. Elongate slots 88*a*, 88*b* are formed at the respective ends of the bar 86, the slots extending longitudinally of the swivel bar. Use and installation of the barrier wall mounting plate 70 is substantially the same as for the plate 10.

Referring to FIGS. 8A and 8B a barrier wall mounting plate 100 comprises a generally rectangular plate 102 having a rounded end 103. Wiring from the lamp socket is extended through an opening 106 in the plate, and the plate has a tapped hole 108 for attaching barrier wall mounting plate 100 to canopy C of a fixture.

This embodiment of the barrier wall mounting plate includes no swivel bar as do the previously described embodiments. Rather, a barrier wall mounting plate 100 has two sets of arcuate slots comprising an inner set of slots 120*a*–120*d* and an outer set of slots 122*a*–122*d*. The respective sets of slots allow plate 100 to be used with different size outlet boxes. Screws (not shown) are inserted through opposed slots in the respective set of slots. The slot width is less than the diameter of the head of a screw. The screws are not fully tightened when first threaded into threaded openings in the outlet box. Rather the outlet box/plate assembly are first rotated so the fixture is in a desired orientation and then the screws are tightened.

What has been described is an electrical lighting fixture including a mounting plate attachable to a portion of the fixture through which electrical wiring for the fixture is routed. This wiring is connected, in turn, to electrical wiring routed from a power source to the fixture through an outlet box. The mounting plate includes a swivel bar to which the outlet box attaches. The electrical wiring, including spliced together sections of wiring, are enclosed within the outlet box and mounting plate, as is required for UL listing. Attaching the outlet box to the swivel bar allows the electrical fixture to be mounted in a preferred orientation regardless of the orientation of the outlet box. Or, the mounting plate has sets of arcuate slots which are used for attaching the fixtures to the outlet box.

An alternative mounting arrangement of the light fixture is shown in FIGS. 9–12. The light fixture 200 includes a socket assembly 202 which is mounted to a barrier wall mounting plate 208. A rain shield base or canopy 204 and a diffuser 206 encase the socket assembly and complete the light fixture 200.

The mounting plate 208 is substantially similar to the mounting plate 100 (FIG. 8). It includes a generally rectangular plate 212 having a rounded end 213. A wiring opening 216 is formed generally in the center of the plate 208. A tapped hole 218 is positioned below the wiring opening 216 to attach the rain shield base 204 to the barrier wall mounting plate 108, as will be described below. The barrier wall mounting plate 208 has two sets of arcuate slots comprising an inner set of slots 220*a*–220*d* and an outer set of slots 222*a*–222*d*. The respective sets of slots allow plate 208 to be used with different size outlet boxes. Lastly, the plate 208 includes a "+" shaped opening 224 above the wiring opening 216. To mount the plate 208 to an outlet box, screws (not shown) are inserted through opposed slots in the respective set of slots 220*a–d* or 222*a–d*. The slots have a width less than the diameter of the head of a screw. The screws are not fully tightened when first threaded into threaded openings in the outlet box. Rather the outlet box/plate assembly are first rotated so the fixture is in a desired orientation and then the screws are tightened.

The socket assembly 202 includes an arm 230 having a mounting end 232 from which a pair of squeezable spring arms 234 extend. The spring arms 234 are received in the "+" opening 224 to snappingly connect the arm 230 to the plate 208. An extension portion 236 of the arm 230 extends from the mounting end 232 and away from (and generally perpendicular to) the plate 208. A bracket 235 is mounted to (or formed at) the free end of the arm extension portion 236.

Although the spring arms 234 extend from the arm 230, they could, instead extend from the plate 212, and the arm portion 232 could be provided with slots to receive the spring arms 234. Other types of snap engagements could be used to mount the arm 230 to the plate 212. For example, flexible spring arms, having outwardly extending fingers, could be used. Non-snapping engagements, such as pin and slot connections or even screws or other similar conventional fasteners could be used to mount the arm 230 to the plate 212. The arm 230 could also be permanently secured to the plate 212, for example, by welding.

A lamp socket 238 is mounted to the bracket 235 which receives a lamp L. In the embodiment shown in FIGS. 9–11, the lamp L is a compact fluorescent lamp, and hence, the socket 238 is a fluorescent lamp socket. Additionally, a ballast 240 is mounted to the arm extension 236. In the embodiment shown in FIG. 12, the lamp L is an incandescent bulb, and hence, the socket 238 is one which receives an incandescent bulb.

Figure 11:
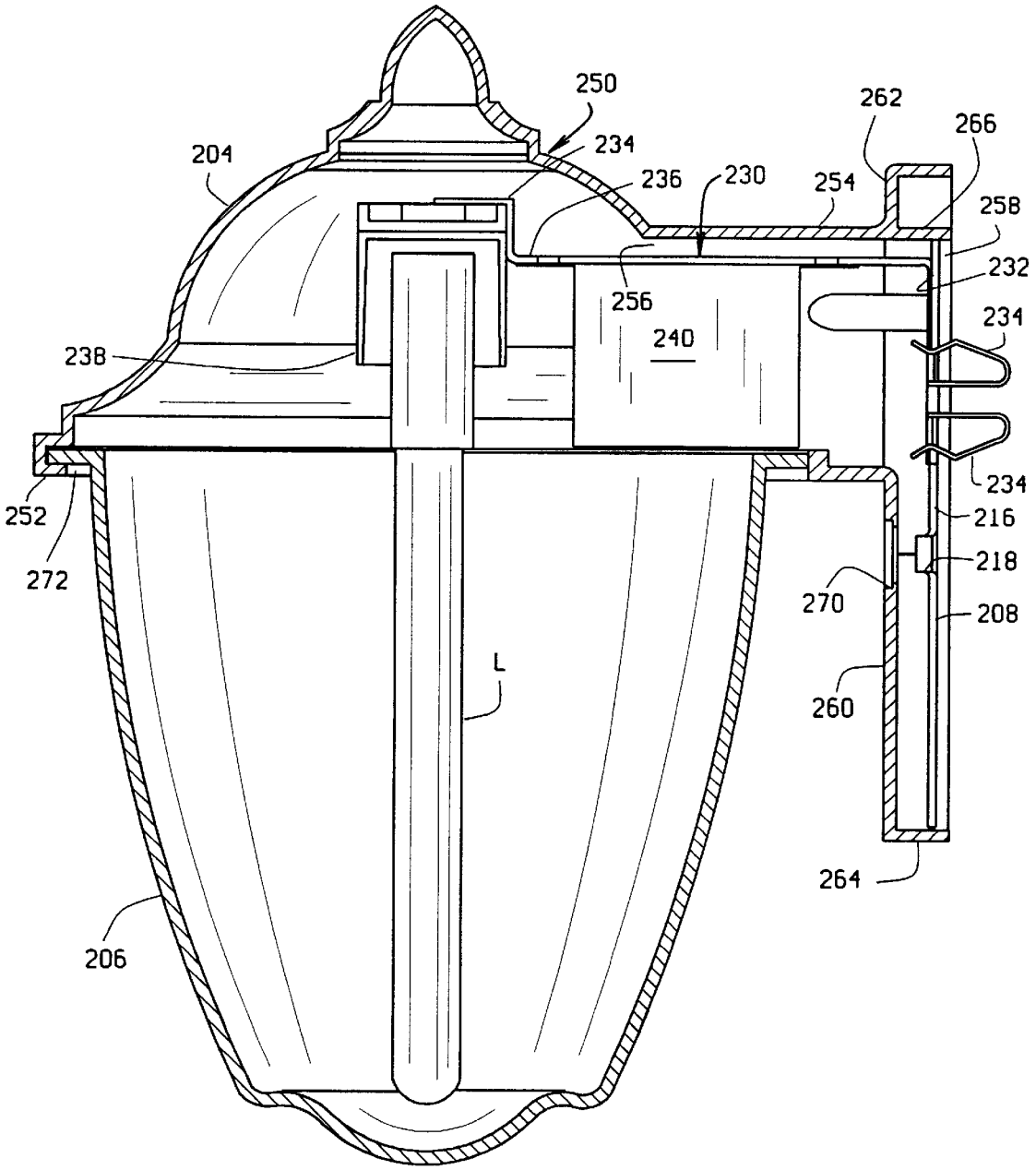
FIG. 11 is a cross-sectional view of the lighting fixture, when assembled.
Figure 12:
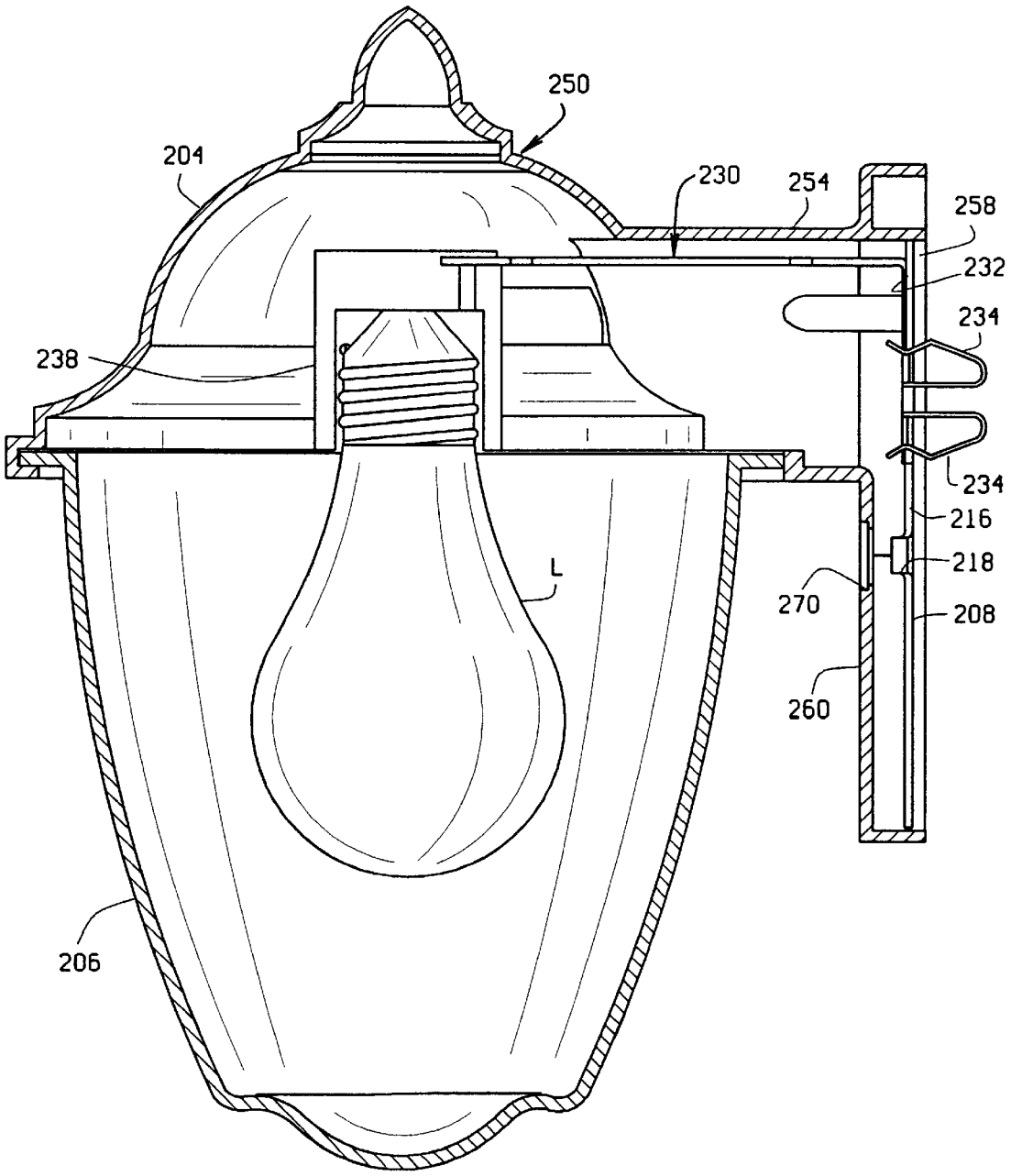
FIG. 12 is a cross-sectional view of the lighting fixture, but adapted to receive an incandescent bulb, rather than a fluorescent bulb.

The rain shield base 204 includes cover or fixture 250 which is sized to surround the socket 238 when the light fixture 200 is assembled. The fixture 250 shown in FIGS. 9–12 is meant to be illustrative only to show the invention. Other fixture designs can be used as well. For example, a lantern fixture, such as shown in FIG. 4, could be used. As seen in FIGS. 11 and 12, the cover 250 has a bottom rim or edge 252 which is at, or below, the bottom edge of the socket 238, Hence, only the lamp or bulb L extends below the cover bottom edge 252, so that all the electrical wires are protected from wind, rain, etc. The cover is shown to be generally dome shaped, but could be any shape desired. A hollow throat 254 extends from the back of the cover 252 and includes a forward opening 256 and a rear or back mouth 258. The bottom of the throat 254 is approximately level with the bottom edge 252 of the cover 250, and a wall 260 extends downwardly from the bottom of the throat 254. Additionally, a small wall 262 extends upwardly from the top of the throat 254. This wall 262 is a decorative wall, and can be omitted if desired. A peripheral lip 264 extends rearwardly from the walls 260 and 262, and surrounds the rear mouth of the throat. A wall 266 extends across the top of the throat 254. The wall 266 in combination with the lip 264 defines a space sized and shaped to encase the barrier wall mounting plate 208, as seen in FIG. 11. As can be appreciated, the upper decorative wall 262, and its associated lip, can be omitted. In this case, the upper wall 266 would form the top portion of the lip 264.

A screw hole 270 is formed in the wall 260 and is positioned to be aligned with the tapped hole 218 in the plate 208, as seen in FIG. 11. The throat 254 is sized to admit the arm 230 from its forward end to its back end at the opening 258. As best seen in FIG. 11,the throat 254 is wider than the arm mounting portion 232 is tall. Thus, the arm 230 can be easily passed through the throat to press the arms 234 into the "+" opening 224 to mount the arm 230 to the plate 208. The throat is also sized to receive the ballast 240 (should a compact fluorescent lamp be used in the lighting fixture).

The diffuser 204 is mounted to the underside of the rain shield cover 250 in any conventional manner. As shown, the diffuser 204 has a lip or flange 272 which is received in a channel in the cover 250. Alternatively, the diffuser could be threaded at its top to be screwed into the cover 250.

In assembling the lighting fixture 200 and electrically connecting the fixture to the wires in the outlet box, the arm 230 is first passed through the throat 254 of the rain shield base 204, and the arm 230 is mounted to the plate 208 by snapping the arms 234 into the "+" opening 224. With the rain shield base 204 hanging loose over the arm, the wires from the socket (or ballast) are passed through the wiring hole 216 in the plate 208 and are connected to the wires in the outlet box. The plate 208 can then be mounted to the outlet box as described above. Thus, the connection between the wires from the socket (or ballast) with the building wires is made within the outlet box, as seen, for example, in FIG. 1. The rain shield base 204 is the positioned over the plate to align its screw hole 270 with the tapped hole 218 in the plate 208, and a screw is passed through the two holes to fix the rain shield base 204 to the plate. Lastly, the diffuser 206 is mounted to the rain shield base 204.

The advantage of the lamp fixture of FIGS. 9–12 over the lamp fixture of FIG. 2 is that the socket and wires are all associated with the arm 230 and the plate 208. Unlike the lamp fixture of FIG. 2, the socket is not a part of the rain shield. Hence, there is no wiring associated with the rain shield, per se. Because the socket is not assembled with the rain shield, assembly costs are reduced. Further, maintaining the socket assembly separate from the rain shield and diffuser reduces the number rain shields and diffusers that need to be kept in inventory. It also allows for a consumer to change the rain shield base 204 and/or the diffuser 206 subsequent to installation of the lighting fixture, without the need to obtain a new socket assembly.

As various changes could be made in the above constructions without departing from the scope of the invention, it is intended that all matter contained in the above description or shown in the accompanying drawings shall be interpreted as illustrative and not in a limiting sense. For example, the cover or rain shield 204 could be connected to the plate 212 in other fashions also. For example, the cover could be provided with squeezable arms similar to the arms 234 or with spring fingers extending from the inner surface of the cover wall 260 and which are received in openings in the plate. This would eliminate the need for a screw and the screw hole 270 in the cover wall 260. These examples are merely illustrative.

We claim:

1. An electrical fixture mountable to an outlet box through which electrical wires for connecting the fixture to a power source are routed, the fixture comprising:

a cover on which a canopy is formed, the cover defining an opening;

a socket assembly independent of the cover; the socket assembly including a mounting arm having a lamp receiving socket mounted at one end of said arm;

a barrier wall mounting plate fitting over the cover opening and to which both said socket assembly and said cover are connected, the plate having an opening therein through which the free ends of the wires extend, the free ends of the wires being spliced together with ends of the electrical wires routed through the outlet box, the mounting plate including connecting means for attaching the plate to the outlet box with the electrical fixture being movable relative to the resulting outlet box/mounting plate assembly for the fixture to be positioned in a preferred orientation regardless of the orientation of the outlet box, and with all of the electrical wires being completely enclosed by the outlet box and mounting plate.

2. The fixture of claim 1 wherein said mounting arm is removably connected to said barrier wall mounting plate by a connector; said connector being on one of said arm and said plate; the other of said arm and said plate receiving said connector.

3. The fixture of claim 2 wherein said connector is a squeezable arm.

4. The fixture of claim 1 wherein said cover includes a hollow throat which extends from said canopy; said mounting arm extending through said throat.

5. The fixture of claim 1 wherein the cover is connected to the plate by a fastener which extends through a surface of the cover and into the barrier wall mounting plate.

6. The fixture of claim 5 wherein the cover includes a wall extending downwardly from a bottom of the throat; the surface through which the fastener extends comprising the wall.

7. The fixture of claim 1 wherein said connecting means comprises a swivel bar rotatably mounted to said plate.

8. The fixture of claim 1 wherein said connecting means comprises at least one arcuate segment formed in the mounting plate and at least one fasteners extending through the arcuate segment for attaching the mounting plate and the outlet box together; the segment being smaller in width than a head of the fastener.

9. An electrical lighting fixture comprising:

a lamp socket in which a light bulb is inserted:

a cover for the lamp socket including a canopy formed for electrical wiring to the lamp socket to be routed through the canopy with one end of each of a plurality of electrical wires to be electrically connected to the socket and the other, free end thereof extending through the canopy, the fixture being attached to an outlet box through which electrical wires for connecting the fixture to a power source are routed; and, a barrier wall mounting plate assembly including a plate and a swivel bar rotatably mounted to the plate, the plate fitting in an opening defined by the canopy, the plate having an opening therein through which the free ends of the wires extend, the free ends of the wires being spliced together with ends of the electrical wires routed through the outlet box; the barrier wall mounting plate assembly being attached to the outlet box by one of the plate and the swivel bar, the canopy being attached to the other of the plate and the swivel bar; attachment of the outlet box to the barrier wall mounting plate assembly allowing the fixture to be positioned in a preferred orientation regardless of the orientation of the outlet box, and with all of the electrical wires being completely enclosed by the outlet box and mounting plate.

10. The lighting fixture of claim 9 wherein said swivel bar is rotatable through 360° for the fixture to be oriented in a desired position with respect to the outlet box.

11. The lighting fixture of claim 10 wherein the barrier wall mounting plate assembly is attached to the outlet box by fasteners extending through the swivel bar and into the outlet box; the swivel bar including an elongate slot at each end thereof through which a fastener for attaching the outlet box and mounting plate together is inserted.

12. The lighting fixture of claim 11 wherein the width of the slot is narrower than a head of the fastener to draw the swivel bar up against the outlet box as the fastener is tightened.

13. The lighting fixture of claim 12 wherein said mounting plate includes a flat plate in which a plurality of arcuate segments are formed, the arcuate segments being larger in width than the head of a screw for the screw to be inserted through a slot in the swivel bar from the side of said plate opposite that to which the outlet box is mounted.

14. The lighting fixture of claim 13 further including screws for attaching the mounting plate to the canopy after the mounting plate is attached to the outlet box, the swivel bar allowing the fixture to be rotated relative to the outlet box to a desired position.

15. An electrical lighting fixture comprising:

a lamp socket in which a light bulb is inserted:

a cover for the lamp socket including a canopy formed for electrical wiring to the lamp socket to be routed through the canopy with one end of each of a plurality of electrical wires to be electrically connected to the socket and the other, free end thereof extending through the canopy, the fixture being attached to an outlet box through which electrical wires for connecting the fixture to a power source are routed; and, a barrier wall mounting plate fitting in an opening defined by the canopy, the plate having an opening therein through which the free ends of the wires extend, the free ends of the wires being spliced together with ends of the electrical wires routed through the outlet box, the mounting plate including a plurality of arcuate segments formed in the mounting plate and spaced uniformly thereabout, fasteners for attaching the mounting plate and the outlet box together being inserted through opposing segments with the segments being smaller in width than the head of a screw so the fasteners, when tightened, draw the outlet box and mounting plate together, the fixture being oriented in a desired position before the fasteners are tightened, attachment of the outlet box to the mounting plate allowing the fixture to be positioned in a preferred orientation regardless of the orientation of the outlet box, and with all of the electrical wires being completely enclosed by the outlet box and mounting plate.

16. The electrical lighting fixture of claim 15 further including an inner set of arcuate segments and an outer set thereof, said sets being concentric with arcuate segments from one set or the other being used depending upon the size of the outlet box to which the fixture is connected.

17. An electrical lighting fixture comprising:

a barrier wall mounting plate mountable to an outlet box;

a socket assembly connected to the barrier wall mounting plate; the socket assembly including a mounting arm connected at one end to the mounting plate and having a lamp receiving socket at another end of said arm; and a cover connected to the barrier wall mounting plate independently of the socket assembly; the cover including a canopy which at least partially surrounds the socket when the lighting fixture is assembled; a hollow throat through which said mounting arm passes, and an opening at a rear of said throat, said barrier wall mounting plate being received in said opening.

18. The fixture of claim 17 wherein said mounting arm is removably connected to said barrier wall mounting plate by a connector; said connector being on one of said arm and said plate; the other of said arm and said plate receiving said connector.

19. The fixture of claim 18 wherein said connector is a squeezeable arm.

20. The fixture of claim 17 wherein the cover is connected to the plate by a fastener which extends through a surface of the cover and into the barrier wall mounting plate.

21. The fixture of claim 20 wherein the cover includes a wall extending downwardly from a bottom of the throat; the surface through which the fastener extends comprising the wall.

* * * * *